United States Patent [19]

Maris et al.

[11] 4,202,121

[45] May 13, 1980

[54] DISPLAY DEVICE

[76] Inventors: George Maris, 2954 Logan Blvd., Chicago, Ill. 60647; Carl G. Nelson, 1941 N. Cleveland, Chicago, Ill. 60604

[21] Appl. No.: 862,016

[22] Filed: Dec. 19, 1977

[51] Int. Cl.[2] ..... G09F 1/12

[52] U.S. Cl. ..... 40/152.1; 40/606

[58] Field of Search ..... 40/607, 606, 152.1, 40/124.1, 493, 607, 479

[56] References Cited

U.S. PATENT DOCUMENTS

| | | | |
|---|---|---|---|
| 193,302 | 7/1877 | Vieira | 40/607 |
| D. 246,274 | 11/1977 | Nelson et al. | 40/124.1 X |
| 659,314 | 10/1900 | Norton | 40/607 |
| 1,087,235 | 2/1914 | Hooper | 40/493 |
| 1,431,433 | 10/1922 | Selby et al. | 40/493 |
| 2,258,560 | 10/1941 | Trunzer | 40/606 |

FOREIGN PATENT DOCUMENTS

| | | | |
|---|---|---|---|
| 904023 | 2/1954 | Fed. Rep. of Germany | 40/607 |
| 366486 | 2/1932 | United Kingdom | 40/607 |

*Primary Examiner*—Louis G. Mancene
*Assistant Examiner*—Wenceslao J. Contreras
*Attorney, Agent, or Firm*—James J. Conlon

[57] ABSTRACT

A modular, graphic display and storage member provides for the attachment of photographs in a curved fashion for ease of viewing, attachment and removal. A number of fins are snap fitted to a central core member so that they may be easily removed by swinging the fin in an arc. Photographs are held in place between the outer end of pairs of fins with reversely positioned claws located at the end of each fin. The module, as assembled, may be used singularly or may be mounted in tandem on a spindle and allowed to rotate for ease of viewing and for decorative purposes.

6 Claims, 4 Drawing Figures

FIG. 1
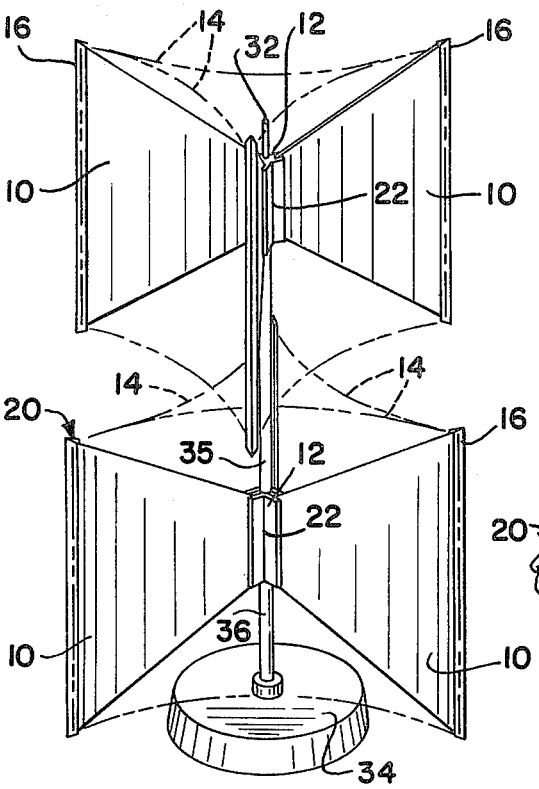
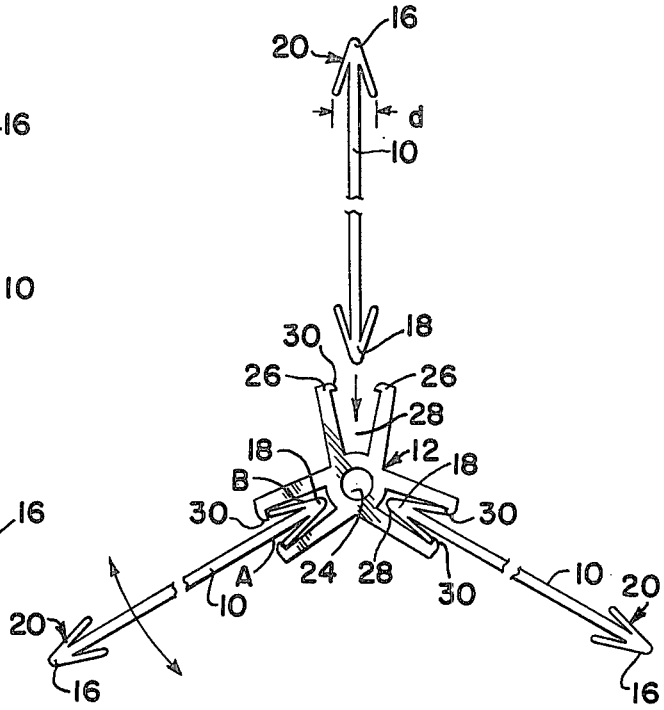
FIG. 2
FIG. 3
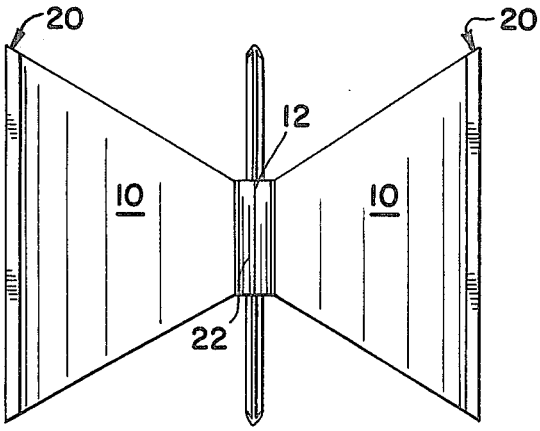
FIG. 4
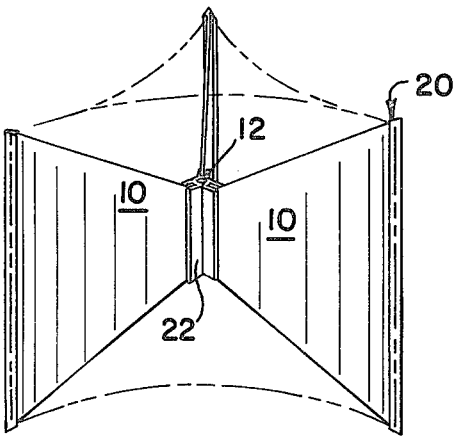

DISPLAY DEVICE

BACKGROUND OF THE INVENTION

1. Field of the Invention:

This invention pertains to display devices used to attach and hold photographs, advertising materials and the like that may be easily viewed when held thereon.

2. Description of the Prior Art:

Prior art display devices such as photo albums having various ways of holding photographs in place, transparent cubicles and the like have met with some limited success but have a number of drawbacks which are overcome by the present invention. With photo albums it is not possible to have photographs constantly in view in any decorative or fashionable manner. With the so-called see-through cubes, the photographs are oftentimes difficult to view because of light reflections off the transparent material.

The display device disclosed herein not only provides a functional graphic or photo display device but also produces an attractive display member that may be used in various sizes for the home, office or use in commercial establishments.

SUMMARY OF THE INVENTION

This disclosure pertains to an easily assembled display device to which a number of photographs may be mounted and easily displayed and viewed.

In use, this invention provides a central, core member with fins removably attached thereto. The fins each have outside ends with bent-over or otherwise contoured portions that are adapted to hold photographs securely. In position the photos extend in a curved or arcuate fashion between the outside ends of adjacent fins.

It is contemplated that the display unit disclosed herein can be used singularly as a desk top or table top unit, or a plurality of units can be mounted vertically on a spindle and designed to rotate for ease of viewing.

It is thus an object of this disclosure to provide a display and storage device for photographs, advertising materials and the like, which has a number of fins extending outwardly from a central core with each fin having a gripping portion associated therewith for firmly holding the graphic in position.

It is yet another object of this invention to provide a display device wherein a central core has a number of short arms arranged in pairs to provide receptacles to receive and hold the outwardly extending fins.

It is another object of this disclosure to provide a graphic display device wherein the central core includes core arms arranged in pairs with each arm having a contoured or detent portion adapted to cooperate with a mating contoured inside end of the outwardly extending fins for firmly joining the fins to the core member.

It is another object of the disclosure to show a core member having outwardly extending receptacles with sides converging toward the core and cooperative with the contoured inside end of an associated fin to urge the end into locking contact with the locking detents of associated core arms.

Another object of the invention is to provide an interlocking arrangement between the core and fins whereby the fins may be snap fitted or moved axially into position and easily removed by moving axially along the length of the core or rotating a fin a short distance causing the inside end of the fin to deflect one of the restraining core arms to release the fin from the locking and gripping action of the core locking detents.

Yet another object of the invention is to provide a graphic display module with fins extending from a core member and having outside ends spaced apart a distance shorter than the length of a photograph in order to hold the photo in a curved manner so that a spring effect is produced by the photograph to hold the photograph in position without the need for support from below.

It is another object of this disclosure to provide a graphic display device that may be used singularly or in combination with another or a plurality of display devices and rotatably mounted on a spindle and contiguous with one another.

It is yet another object of this invention to provide a graphic display device having fins extending outwardly from a central core, each fin member having an outside, picture gripping end with the same coutour as the inside, core attached end.

These and other objects of the invention will become apparent to those having ordinary skill in the art with reference to the following drawings, description and appended claims.

BRIEF DESCRIPTION OF THE DRAWINGS

FIG. 1 is a pictorial illustration of the graphic display device;

FIG. 2 is a top plan view of the display device;

FIG. 3 is a front elevantional view of a single display device; and

FIG. 4 is a pictorial illustration of a single display device.

DETAILED DESCRIPTION

Referring now to the drawings and in particular to FIG. 1 two modular displays are shown mounted vertically in tandem with a number of fins 10 extending outwardly from a central core 12. In the embodiment shown, fins 10 are arranged or spaced 120 degrees apart to provide a mounting means for holding three photographs. The photographs are indicated schematically at 14 and shown as they would appear when held by the modular display device. As it can be seen, the photographs 14 are slightly bowed to provide a spring effect which utilizes the spring characteristics of the photo in conjunction with the restraint at each vertical edge of the photo to hold the photo or other graphic material in place without any vertical or bottom support. As it is known from referring to the drawings, this type of photo restraint system is not limited to photographs but can be made in various sizes and used with other visual display devices such as advertising materials and the like. The fins 10 and core 12 can be extruded or otherwise manufactured from rigid polyvinyl or other thermoplastic or suitable material.

Each fin 10 has an outer gripping edge 16 and an inner gripping edge 18. It is contemplated that outer edge 16 of each fin 10 can be longer than inner edge 18. When the photographs are in position, outer edge 16 provides a framing effect and inner edge 18 is obscured if not concealed from view to provide an additional, visually pleasing and functional feature. When three photographs are held by outer grip edges 20, the spring effect of each photograph rigidifies the unit and aligns the fins to extend radially from the core 12 thus eliminating the need for strict adherence to all dimensional specifications when manufacturing the members.

As is shown in FIGS. 1–2, outer edge 16 is contoured in such a fashion as to provide a pair of converging, gripping edges that form a shape similar to an arrowhead and is designated 20. Similarly, the inner edges 18 also have this arrowhead contour 20. For ease of manufacturing, and cost savings, it is contemplated that each edge be identical; however, other configurations could be used.

Each inner grip edge 18 is nested within an associated receptacle 28 of the core member 12. Core member 12 includes a body 22 which may include a cylindrical opening 24 extending therethrough (FIG. 2). Extending outward from the body 22 are pairs of arm members 26. These arms are arranged in pairs to provide a radially extending opening or receptacle 28 into which the inner edges 18 of the associated fins 10 are nested. As shown in FIG. 2 arms 26 include formed portions or detents 30. Detents 30 restrict the opening to receptacle 28. The inner edges 18 of each fin 10 and the ends of the arrowheads are snapped into position and securely held in place by detents 30. Thus, when the individual fins 10 are snapped into position by urging the inner ends 18 and the arrowhead portions radially into the associated openings 28, there is a snap-fit connection which securely holds the fins 10 as an integral member with the hub 12. Also, inner ends 18 may be slid or axially fitted into an associated receptacle 28.

Referring again to FIG. 1, there is shown a photo display assembly which utilizes several of the display modules in a tandem arrangement positioned about a spindle 32 which extends from base member 34. A number of cylindrical separators 35, 36 can be used to space the display members in a convenient distance to allow each to freely rotate.

Referring again to FIG. 2, and in particular to the arrowhead contour of each inner end 18, it is noticed that each side of the arrowhead is engageable with the locking detents 30 of each core arm 26. To remove fin 10, it is moved clockwise or counter-clockwise with respect to the core 12 as shown by the arrows in FIG. 2. With such movement a portion of the fin 10, designated A, contacts a detent 30 and the tip of the inner edge 18, designated B, contacts the inner wall of the opposite arm 26 and urges the arms 28 apart in a cantilever fashion to open the sides of the receptacle to allow the inner edge 18 and arrowhead to be easily removed in a pivotal manner.

It is also noticed with reference to FIG. 2 that the arrowhead shaped inner edges 18 are held in place against tabs 30. This locking is provided by the contour of receptacle 28 which has edges which extend in a converging direction toward core 12 to give receptacle 28 a slight wedge shape. It is also noticed that the distance between the tips of each arrowhead leg (designated "d" in FIG. 2) is greater than the width of the associated receptacle opening 28. Thus, when inserted into a receptacle 28 the arrowhead legs are deflected and provide a spring force against the inside, converging walls of the receptacle. This wedge or taper feature acts in conjunction with the arrowhead legs in such a fashion as to urge the fins outwardly and urge free ends of the arrowhead legs into locking contact with the detents 30.

The foregoing description and drawings merely explain and illustrate the invention and the invention is not limited thereto, except insofar as the appended claims are so limited, as those who are skilled in the art and have the disclosure before them will be able to make modifications and variations therein without departing from the scope of the invention.

What is claimed is:

1. A graphic display device for holding and showing visual display such as a number of photographs, and other visual members, the improvement comprising:
- a base member;
- a display spindle with means attached to the base member and having means extending upwardly therefrom;
- a core;
- said core having means mountable and rotatable about said spindle;
- fin means with means extending outwardly from said core;
- said core having means for releasably connecting the fin means;
- said fin means including outer grip means for engaging and holding a visual display in a curved, self-supporting manner;
- means positioning the core above the base member to allow the core and attached fin means and visual display to rotate freely about said spindle;
- said core includes pairs of arm members extending outwardly thereof;
- said arm members spaced apart a first distance to provide a receptacle means for receipt of the fin means;
- said fin means having a surface and having raised means extending from said surface to provide inner grip means to contain the associated fin within the receptacle means;
- said arm members include cantilever means deflectable as said inner grip means of the fin means are inserted within the receptacle means to thereby provide biasing, holding force for retaining the fin means within said receptacle means and attached to said core.

2. The graphic display device of claim 1 wherein:
- said inner grip means for connecting said fin means with the core comprise means extending from the fin means and having a first length;
- said receptacle means of the core means having a depth greater than the length of the raised surface of the fins whereby the raised surface may be inserted into the receptacle and are into gripping contact with the arm members.

3. The graphic display device of claim 1 wherein said outer grip means and said inner holding means of said fin means includes:
- arrowhead shaped means;
- said arrowhead shaped means comprising a pair of fin extensions with means extending in a plane to converge at an end of said fin means.

4. The graphic display device of claim 1 wherein:
- said arm members of the core receptacle include tab detent means providing a restricted opening of the receptacle for restraining said fin means.

5. The graphic display device of claim 4 wherein said inner grip means of the fin means includes:
- means on said fin engageable with one tab detent means as the fin is rotated;
- arm contact means spaced from the means on the fin engageable with the tab detent means and having means disposed to contact the other receptacle arm as the fin is rotated to open the restricted opening for removal of said fin means.

6. The display device of claim 1 wherein said fin means comprises:
- an inner edge cooperative with the receptacle means;
- an outer edge spaced from said inner edge and having a length greater than the length of the inner edge.

* * * * *